US005477217A

United States Patent [19]

Bergan

[11] Patent Number: 5,477,217

[45] Date of Patent: Dec. 19, 1995

[54] BIDIRECTIONAL ROAD TRAFFIC SENSOR

[75] Inventor: Terry Bergan, Saskatoon, Canada

[73] Assignee: International Road Dynamics, Saskatoon, Canada

[21] Appl. No.: 198,634

[22] Filed: Feb. 18, 1994

[51] Int. Cl.[6] ..... G08G 1/01

[52] U.S. Cl. ..... 340/933; 340/665; 340/666; 200/86 A; 310/339; 310/800

[58] Field of Search ..... 340/933, 665, 340/666; 200/86 A; 310/339, 800

[56] References Cited

U.S. PATENT DOCUMENTS

| | | | |
|---|---|---|---|
| 1,992,214 | 2/1933 | Katz | 177/329 |
| 2,067,336 | 1/1937 | Power | 235/92 |
| 2,161,896 | 6/1939 | Cutler | 200/86 |
| 2,163,960 | 6/1939 | Paver | 200/86 |
| 2,244,933 | 6/1941 | Armstrong | 200/86 |
| 2,268,925 | 1/1942 | Cooper | 235/92 |
| 2,319,153 | 5/1943 | Nolde | 235/92 |
| 2,823,279 | 2/1958 | Schulenburg | 200/86 |
| 2,909,628 | 10/1959 | Cooper | 700/86 |
| 3,079,077 | 2/1963 | Bolton | 239/99 |
| 3,109,157 | 10/1963 | Bolton | 340/940 |
| 3,141,612 | 7/1964 | Bolton | 235/99 |
| 3,188,422 | 6/1965 | Wilcox | 200/86 |
| 3,486,008 | 5/1973 | Fischel | 235/92 |
| 3,732,384 | 5/1973 | Fischel | 200/313 |
| 3,900,830 | 8/1975 | Peterson | 340/940 |
| 3,911,390 | 10/1975 | Myers | 340/940 |
| 3,927,389 | 12/1977 | Necloff | 340/940 |
| 4,013,851 | 3/1977 | Abhodanto | 200/86 R |
| 4,354,134 | 10/1982 | Micheron | 310/800 |
| 4,383,239 | 5/1983 | Robert | 340/940 |
| 4,547,691 | 10/1985 | Valdois et al. | 310/361 |
| 4,609,845 | 9/1986 | Soni et al. | 310/357 |
| 4,629,925 | 12/1986 | Booth et al. | 310/330 |
| 4,712,423 | 12/1987 | Siffert et al. | 73/146 |
| 4,799,381 | 1/1989 | Tromp | 73/146 |
| 4,839,480 | 6/1989 | Buckley | 200/86 A |
| 4,862,163 | 8/1989 | Sobut | 390/940 |
| 4,901,334 | 2/1990 | Gibson | 377/9 |
| 5,008,666 | 4/1991 | Gebert et al. | 340/933 |
| 5,115,109 | 5/1992 | Fisher | 200/86 A |
| 5,164,732 | 11/1992 | Brockelsky et al. | 340/933 |
| 5,206,642 | 9/1993 | Gregoire et al. | 340/933 |
| 5,239,148 | 8/1993 | Reed | 200/86 A |

FOREIGN PATENT DOCUMENTS

| | | |
|---|---|---|
| 749552 | 12/1960 | Canada . |
| 727292 | 2/1966 | Canada . |
| 902208 | 6/1972 | Canada . |
| 972181 | 8/1975 | Canada . |
| 1048121 | 2/1979 | Canada . |
| 1144391 | 4/1983 | Canada . |
| 1194708 | 10/1985 | Canada . |
| 1218869 | 3/1987 | Canada . |
| 1262568 | 10/1989 | Canada . |
| 1266119 | 2/1990 | Canada . |
| 1267216 | 3/1990 | Canada . |

*Primary Examiner*—John K. Peng
*Assistant Examiner*—Edward Lefkowitz
*Attorney, Agent, or Firm*—Nixon & Vanderhye

[57] ABSTRACT

A bidirectional road traffic sensor include several respective lengths of coaxial piezoelectric cable each having a conductive core, a conductive polymer surrounding the core, a conductive sheath therearound and an electrically non-conductive jacket therearound. The cables are spliced together such that conductive core and conductive sheath of one length of piezoelectric cable is spliced respectively to the conductive sheath and conductive core of another piezoelectric cable. The splices are encapsulated in an electrically non-conductive material so that the spliced lengths of piezoelectric cables respectively constitutes positive, neutral and negative piezoelectric sensors. Pressure changes in the piezoelectric sensors are caused by vehicle passage thereover. In such a manner, electrical pulses are responsively produced by passage of vehicles traversing respective detection zones defined by the sensors and moving in respective particular directions so that such passage of such vehicles may be registered.

17 Claims, 2 Drawing Sheets

BIDIRECTIONAL ROAD TRAFFIC SENSOR

BACKGROUND OF THE INVENTION

1. Field of the Invention

This invention relates to a bidirectional road traffic sensor which is capable of simultaneously monitoring two or more lanes of traffic for counting and/or classifying individual vehicles.

2. Description of the Prior Art

The term "road traffic" is used to include wheeled vehicles such as automobiles, having flexible or pneumatic tires covering a substantial area of the roadway in supporting the weight of the vehicle on wheels spaced-apart transverse to the direction of movement of the vehicle, and includes automotive vehicles in a toll collection lane or in a low speed vehicle weighing lane for example.

One of the problems facing highway engineers is the necessity to provide adequate traffic control systems which can readily handle the ever increasing loads of automotive traffic. Vital to the solution of this problem is the need for continuous accurate information concerning the number of vehicles and/or type (classification) of vehicles passing over a particular stretch of highway. Often, in order to provide maximum utilization of given highway facilities, it is necessary to use a particular single traffic lane for vehicles moving in both directions, e.g., the center lane of a three-lane highway, or multi-lane highways using all but one lane for traffic in a particular direction during rush hours.

It is frequently necessary in the control of vehicular traffic to provide means for the selective detection and/or counting of vehicles in accordance with their direction of travel as they pass through a defined detection area.

The U.S. Federal Highway Administration and other government agencies both in Canada and in the U.S.A., often require the submission of reports concerning truck travel at specific locations on roadways before authorizing funding for the repair and improvement of such roadways. Such reports are typically submitted in a format known as the Federal Highway Administration vehicle Classification Scheme. A number of classifying machines are currently in manufacture. Typically, they require two axle detector inputs positioned a known distance apart. The machine measures the time between axle actuations, calculates the speeds at which the axles are travelling, counts the number of axles travelling at the same rate of speed, and then, depending upon results, records the vehicle type in a predetermined classification bin. Such studies are typically undertaken over a continuous 24 hour period and are broken down into one hour increments. Portable axle detector devices manufactured and available today vary greatly in cost, durability, limitations of operation and set up procedure difficulty.

Heretofore, in traffic counting systems on a multi-lane highway, a treadle switch was embedded in each lane of the highway for actuation by the wheels of a vehicle, and each treadle controlled a circuit operating a counter to count the vehicle axles passing over the lane. In such systems it was necessary to add the counts of each counter in order to obtain the total count in all lanes. Furthermore, the initial cost of such systems proved expensive, and the operating expenses attached thereto, also proved to be slightly higher than most road authorities had anticipated.

Such treadle switch traffic counting system are now obsolete. In more recent traffic counting systems, it has been found that vehicles usually cross the sensing mechanisms in different lanes, simultaneously or substantially so, so that the time between actuation of the sensors is less than it takes to operate a counter.

The art replete with patents directed to traffic counting in a single lane of traffic and/or for unidirectional traffic. Typical examples include the following: D. Katz U.S. Pat. No. 1,992,214 patented on Feb. 26, 1933; Power U.S. Pat. No. 2,067,336 patented Jan. 12, 1937; C. D. Cutler U.S. Pat. No. 2,161,896 patented Jun. 13, 1939; J. M. Paver U.S. Pat. No. 2,163,960 patented Jun. 27, 1939; R. R. Armstrong U.S. Pat. No. 2,244,933 patented Jun. 10, 1941; G. V. Nolde U.S. Pat. No. 2,319,153 patented May 11, 1943; E. J. Schulenburg U.S. Pat. No. 2,823,279 patented Feb. 11, 1958; H. A. Wilcox U.S. Pat. No. 2,885,508 patented May 5, 1959; U.S. Pat. No. 2,909,628 to Cooper; J. P. Roscoe U.S. Pat. No. 2,922,003 patented Jan. 19, 1960; H. A. Wilcox U.S. Pat. No. 3,188,422 patented Jun. 8, 1965; U.S. Pat. No. 3,486,008; G. Fischel U.S. Pat. No. 3,732,384 patented May 8, 1973; V. Necloff U.S. Pat. No. 3,927,389 patented Dec. 16, 1977; C. Abhodanto U.S. Pat. No. 4,013,851 patented Mar. 22, 1977; C. M. Tromp U.S. Pat. No. 4,799,381 patented Jan. 24, 1989; A. Buckley U.S. Pat. No. 4,839,480 patented Jun. 13, 1989; B. Sobut U.S. Pat. No. 4,862,163 patented Aug. 29, 1989; J. R. Fisher U.S. Pat. No. 5,115,109 patented May 19, 1992; J. L. Banke Canadian Patent No. 727,292 patented Feb. 1, 1966; H. C. Kendall et al. Canadian Patent No. 749,552 patented Dec. 27, 1960; S. Iwamoto et al Canadian Patent No. 902,208 patented Jun. 6, 1972; and W. T. Lawrence Canadian Patent No. 1,048,121 patented Feb. 6, 1979.

The patent literature also purported to provide solution to the problem of means for counting and totalizing, on a single counter, the vehicular traffic on a multi-lane highway. Among the patents allegedly providing solution to such problem are the following:

B. Cooper U.S. Pat. No. 2,268,925 patented Jun. 6, 1942, provided a device which included, in combination, a plurality of switches, and an electromagnetic counter having an electromagnet. Means were provided to energize the electromagnet once for each actuation of any of the switches when the period between actuations of different switches was either greater or less than the time it took for the counter to operate in making a count. The system also included means to prevent more than one energization of the electromagnet upon actuation of a switch, irrespective of the duration of actuation of that switch.

N. A. Bolton U.S. Pat. No. 3,079,077 patented Feb. 26, 1963 provided separate detection and counting of a plurality of objects simultaneously passing a fixed monitoring point. The patented system included a plurality of vehicle detection means located across a passageway. Such means defined respective detection zones more closely spaced successively than the width of any vehicle. Each zone was constructed and arranged as to provide a momentary output signal upon the passage of a vehicle through the respective detection zone. Counting means were provided for counting discrete input signals successively applied to its input circuit. Means were provided for coupling each vehicle detection means to the input circuit, such coupling means responded to substantially simultaneous output signals from vehicle detectors respectively defining adjacent detection zones by supplying a single input signal to the input circuit of the counting means. On the other hand, such coupling means responded to substantially simultaneous output signals from vehicle detectors respectively defining non-adjacent detection zones by supplying time-spaced input signals to the input circuit. In this way, a single vehicle passing simultaneously through adjacent detection zones was counted singly by the counting circuit means but a plurality of vehicles passing simultaneously through non-adjacent detection zones were separately counted by the counting circuit means.

N. A. Bolton U.S. Pat. No. 3,109,157 patented Oct. 29, 1963 provided a system for the selective detection, counting and control of automotive traffic travelling past a particular point in more than one direction. The patented system included at least two successive detection zones. A plurality of vehicle responsive means was provided, each means defining a respective one of the detection zones and each being operated to a distinctive condition by the passage of a vehicle through the respective detection zone. Direction detection means were also provided, along with means governed by the vehicle-responsive means for the respective zones for operating the direction detection means to a distinctive condition indicative of the passage of a vehicle in one particular direction along the roadway only for a particular corresponding sequence of vehicle detections by the two vehicle responsive means. Vehicle registering means were provided, along with control means for the vehicle registering means governed jointly by the vehicle-responsive means for the respective detection zones, and by the direction detection means for registering the passage of the vehicle moving in a particular direction only when the direction responsive means had been controlled to the distinctive condition and the second-operated of the vehicle detection means for the particular direction of vehicle travel had been restored to its normal condition. Registration prevention means were provided for preventing, when operated from its normal condition, the registration of a count by the vehicle-registration means. Means were provided for operating the registration-prevention means only when the interval between the successive operations of the two vehicle-detection means in response to a single vehicle was substantially in excess of that normally expected for a vehicle passing through the detection. Such operating means served to restore the registration-prevention means when the vehicle was detected by the second-operated vehicle detection means.

N. A. Bolton U.S. Pat. No. 3,141,612 patented Jul. 21, 1964 provided a system for the selective detection of vehicles passing over either or both of a multiple number of lanes and through a predetermined detection area according to their direction of travel. The patented system included at least two spaced first and second vehicle-detection zones, each zone being defined by a respective vehicle-detector means. Each vehicle detector means was distinctively controlled by the passage of a vehicle through the respective detection zone. Vehicle-registering means were provided which were governed by both the vehicle-detector means for registering the passage of a vehicle in a particular direction as the vehicle while moving in the particular direction sequentially traverses the successive detection zones. The registering means normally registered the passage of the vehicle when the vehicle detector means for the second of the detection zones to be traversed sensed that the vehicle had vacated the second detection zone. Means were provided which were distinctively controlled by the vehicle-detector for the first detection zone when the first detection zone became occupied at a time when the second detection zone was still occupied. Such last-named means, when in the distinctive condition, prevented registration of a first vehicle upon its vacating the second detection zone at a time when the first detection zone was occupied by a second vehicle and permitted registration of the first vehicle only provided that thereafter both the detection zones became simultaneously occupied. Such means was restored to its normal condition by the vehicle-registering means when the first vehicle had been registered. In this way, a vehicle reversing its direction even after having vacated the first detection zone was not registered.

G. P. Gibson U.S. Pat. No. 4,901,334 patented Feb. 13, 1990 provided counters or tallying devices which were actuated by vehicle passage over a sensing means in place on a roadway surface, for selective lane use. The patented traffic counter apparatus included a housing assembly including a base adapted for securement to the roadway surface between two traffic lanes. A housing was provided having a low profile to the roadway and having inclined exterior walls. Means were provided for removably mounting the housing to the base, the housing defining a chamber closed by the base and constructed of material to withstand being run over by any roadway vehicle. A road tube was provided for disposition in a traffic lane. The road tube had an end attached to the housing assembly. Pressure responsive transducer switch means were provided in the chamber which were responsive to air pressure changes in the road tube caused by vehicle passage thereover, in order to produce electrical pulses. Signal transmitting means were provided in the chamber connected to, and actuated by, the pressure responsive switch means for transmitting the electrical pulses. Tally means were provided remote from the housing assembly, which was triggered by the pulses from the signal transmitting means.

J. W. Reed U.S. Pat. No. 5,239,148 patented Aug. 24, 1993 provided a portable apparatus for discriminating the counting of vehicular traffic in multiple lanes. The patented apparatus was in the form of a traffic counting cord. Such cord had a plurality of sections designed to be identical in physical characteristics, set-up procedures, durability and performance as a road tube. Each section had a portion with conductive upper and lower members and a portion with non-conductive upper and lower members. The upper and lower members were separated by resilient, non-conductive material. Embedded within the members were a plurality of wires insulated with nylon or other material and at least one non-insulated wire which was in contact with the conductive member. A count occurred when traffic impacting the cord caused the upper and lower members of a section to make contact. Individual counts for each lane could be obtained by cross-wiring the sections, so that the uninsulated conductors of each section were routed to a counter through insulated conductors or wires of the other sections. Any even or odd number of lanes, typically four, six, or eight lanes could therefore be accommodated, although there was no theoretical limit.

SUMMARY OF THE INVENTION

(i) Aims of the Invention

As described hereinabove, numerous electrical treadle switches had previously been provided but such switches have generally been replaced by pneumatic counting devices, which have higher reliability and are more easily transportable. However, as also previously discussed, pneumatic systems have significant disadvantages in their ability to count multiple lanes of traffic simultaneously and by being subject to inclement weather conditions. In view of the above limitations of the related art, it is an object of the invention to provide a portable and durable multiple lane traffic counting system.

It is a further object of the invention to provide a traffic counting system which does not require the use of an air pulse, but instead operates based on piezoelectric switch means.

It is a still further object of the invention to provide a traffic counting system which is compatible with existing traffic counting hardware.

It is another object of the invention to provide a traffic counting system which is portable and can be installed without additional training of personnel familiar with previously used traffic counting systems.

It is a further object of the invention to provide a traffic counting system which is durable and accommodates lane based traffic classification studies.

It is still another object of the invention to provide a highly accurate traffic counting system which detects vehicles travelling at both low and high speeds across the sensors.

It is still another object of the invention to provide a traffic counting system which need not be manned on a regular basis.

Yet another object of this invention is to provide a traffic counting circuit for registering on a counter, the total count of all vehicle axles which pass over the sensors in the lanes.

Still another object of this invention is to provide a traffic counting circuit to count the vehicle traffic moving in one direction on one counter, and to count the vehicle traffic moving in the opposite direction on another counter.

Another object of this invention is to provide a counting circuit which may be readily expanded to use any desired number of senors, and which may be readily reduced to as few sensors as desired.

It is an object of this invention to provide a system that will monitor vehicles passing a fixed point, indicating their direction of travel and maintaining an accurate count of the vehicles travelling in each direction.

It is a further object of this invention to provide a system which can be used to monitor vehicles using a single highway traffic lane for travel in more than one direction.

Important objectives include: the provision of an apparatus for installation on multi-lane highway for selective counting of vehicle traffic in one or more lanes; the provision of an apparatus for installation in a roadway and having a housing configured for placement so as to not hinder traffic in either lane; and the provision of an apparatus having a housing assembly in which electrical components having a housing assembly in which electrical components are housed which does not constitute a distraction to motorists by reason of its placement and profile.

(ii) Statement of Invention

The present invention provides a bidirectional road traffic sensor comprising: (i) a first length of a coaxial piezoelectric cable having a conductive core, a conductive polymer surrounding the core, a conductive sheath therearound and an electrically non-conductive jacket therearound; (ii) a second length of a coaxial piezoelectric cable having a conductive core, a conductive polymer surrounding the core, a conductive sheath therearound and an electrically non-conductive jacket therearound; (iii) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor; (iv) a third length of a coaxial piezoelectric cable having a conductive core, a conductive polymer surrounding the core, a conductive sheath therearound, and an electrically non-conductive jacket therearound; and (v) a second splice between the second length of coaxial piezoelectric cable and the third length of piezoelectric cable in which the conductive core of the second length of piezoelectric cable is spliced to the conductive core of the third piezoelectric cable, and in which the conductive sheath is spliced to the conductive sheath of the second piezoelectric cable, the second splice being encapsulated in an electrically non-conductive material; thereby constituting the second length of piezoelectric cable as a neutral piezoelectric sensor, and further constituting the third length of piezoelectric cable as a negative piezoelectric sensor.

The present invention also provides a bidirectional road traffic sensor comprising: (i) a shielded coaxial cable including a conductive core, a conductive sheath and an electrically non-conductive jacket therearound; (ii) a first length of a coaxial piezoelectric cable having a conductive core, a conductive polymer surrounding the core, a conductive sheath therearound and an electrically non-conductive jacket therearound; (iii) a splice between the shielded coaxial cable and the first length of coaxial piezoelectric cable in which the conductive core of the coaxial lead cable is spliced to the conductive core of the first length of piezoelectric cable, and in which the conductive sheath of the coaxial lead cable is spliced to the conductive core of the first piezoelectric cable, the third splice being encapsulated in an electrically non-conductive material, thereby constitutes the shielded coaxial cable as a lead cable; (iv) a second length of a coaxial piezoelectric cable having a conductive core, a conductive polymer surrounding the core, a conductive sheath therearound and an electrically non-conductive jacket therearound; (v) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor; (vi) a third length of a coaxial piezoelectric cable having a conductive core, a conductive polymer surrounding the core, a conductive sheath therearound, and an electrically non-conductive jacket therearound; and (vii) a second splice between the second length of coaxial piezoelectric cable, and the third length of piezoelectric cable, in which the conductive core of the second length of piezoelectric cable is spliced to the conductive core of the third piezoelectric cable, and in which the conductive sheath is spliced to the conductive sheath of the second piezoelectric cable the second splice being encapsulated in an electrically non-conductive material, thereby constituting the second length of piezoelectric cable as a neutral piezoelectric sensor, and also constituting the third length of piezoelectric cable as a negative piezoelectric sensor.

The present invention further provides a system for the selective detection of vehicles passing over either or both of a multiple number of lanes and through a predetermined detection area according to their direction of travel, the system comprising: at least two vehicle detector zones, each zone being provided with a single bidirectional road traffic sensor comprising: (i) a shielded coaxial cable including a conductive core, a conductive sheath and an electrically non-conductive jacket therearound; (ii) a first length of a coaxial piezoelectric cable having a conductive core, a conductive polymer surrounding the core, a conductive sheath therearound and an electrically non-conductive jacket therearound; (iii) a splice between the shielded coaxial cable and the first length of coaxial piezoelectric cable in which the conductive core of the coaxial lead cable is spliced to the conductive core of the first length of piezoelectric cable, and in which the conductive sheath of the coaxial lead cable is spliced to the conductive core of the first piezoelectric cable, the third splice being encapsulated in an electrically non-conductive material, thereby constitutes the shielded coaxial cable as a lead cable; (iv) a second length of a coaxial piezoelectric cable having a conductive core, a conductive polymer surrounding the core, a conductive sheath therearound and an electrically non-conductive jacket therearound; (v) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor; (vi) a third length of a coaxial piezoelectric cable having a conductive core, a conductive polymer surrounding the core, a conductive sheath therearound, and an electrically non-conductive jacket therearound; and (vii) a second splice between the second length of coaxial piezoelectric cable, and the third length of piezoelectric cable, in which the conductive core of the second length of piezoelectric cable is spliced to the conductive core of the third piezoelectric cable, and in which the conductive sheath is spliced to the conductive sheath of the second piezoelectric cable the second splice being encapsulated in an electrically non-conductive material, whereby pressure changes in the piezoelectric sensors caused by vehicle passage thereover, produces electrical pulses for registering the passage of a vehicle in a particular direction as the vehicle while moving in the particular direction traverses one detection zone and for registering the passage of a vehicle in a particular direction as the vehicle while moving in the particular direction traverses the other detection zone. Such system may also be provided with two spaced-apart bidirectional road traffic sensors for classifying moving traffic.

The present invention still further provides a traffic counter including bidirectional road traffic sensors comprising: (i) a shielded coaxial cable including a conductive core, a conductive sheath and an electrically non-conductive jacket therearound; (ii) a first length of a coaxial piezoelectric cable having a conductive core, a conductive polymer surrounding the core, a conductive sheath therearound and an electrically non-conductive jacket therearound; (iii) a splice between the shielded coaxial cable and the first length of coaxial piezoelectric cable in which the conductive core of the coaxial lead cable is spliced to the conductive core of the first length of piezoelectric cable, and in which the conductive sheath of the coaxial lead cable is spliced to the conductive core of the first piezoelectric cable, the third splice being encapsulated in an electrically non-conductive material, thereby constitutes the shielded coaxial cable as a lead cable; (iv) a second length of a coaxial piezoelectric cable having a conductive core, a conductive polymer surrounding the core, a conductive sheath therearound and an electrically non-conductive jacket therearound; (v) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor; (vi) a third length of a coaxial piezoelectric cable having a conductive core, a conductive polymer surrounding the core, a conductive sheath therearound, and an electrically non-conductive jacket therearound; and (vii) a second splice between the second length of coaxial piezoelectric cable, and the third length of piezoelectric cable, in which the conductive core of the second length of piezoelectric cable is spliced to the conductive core of the third piezoelectric cable, and in which the conductive sheath is spliced to the conductive sheath of the second piezoelectric cable the second splice being encapsulated in an electrically non-conductive material which pressure changes in the piezoelectric sensors caused by vehicle passage thereover, produces electrical pulses; means for removably mounting the bidirectional road traffic sensor to a roadway; signal transmitting means connected to, and actuated by, the bidirectional road traffic sensor for transmitting the electrical pulses; and tally means triggered by the pulses from the signal transmitting means for tallying the pulses. The traffic counter may also be provided with two spaced-apart bidirectional road traffic sensors for classifying moving traffic.

(iii) Other Features of the Invention

By one feature of this invention, the conductive core is made of copper.

By another feature of this invention, the conductive sheath is formed of braided copper.

By yet another feature of this invention, the conductive polymer is polyvinylidene chloride.

By still another feature of this invention, the non-conductive jacket is formed of polyethylene.

By yet another feature of this invention, the first and second splices are encapsulated in polyethylene.

By still another feature of this invention, the third splice is encapsulated in natural or synthetic rubber.

BRIEF DESCRIPTION OF THE DRAWINGS

In the accompanying drawings.

Figure 1:
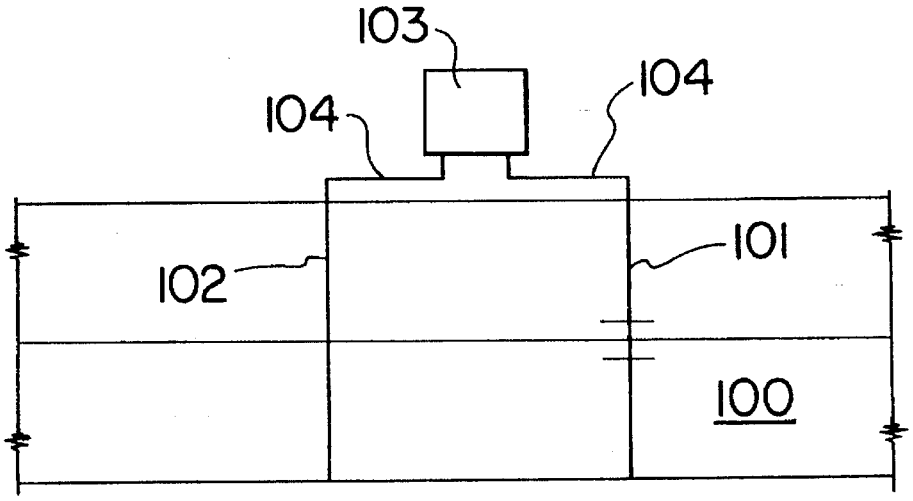
FIG. 1 is a schematic plan view of a typical installation of the system of an embodiment of the present invention.

DESCRIPTION OF PREFERRED EMBODIMENTS (i) Description of FIG. 1

As seen in FIG. 1, which shows a typical sensor layout, a roadway 100 is provided in one embodiment with a pair of spaced-apart bidirectional piezoelectric sensors 101,102 spaced typically 12 to 16 feet apart. The construction of each bidirectional piezoelectric sensor will be described hereinafter with respect to FIG. 2. The bidirectional piezoelectric sensors are operatively connected to a traffic counter/classifier 103, by lead cables 104.

If the embodiment of the invention includes one piezoelectric sensor 101, the invention is useful for counting two lanes of traffic in adjacent lanes. If the embodiment of the invention includes two piezoelectric sensors 101,102, the invention may be used for classification of traffic in one or two lanes.

A detector loop (not shown) may be provided between the sensors 101,102 to detect vehicle presence.

Figure 2:
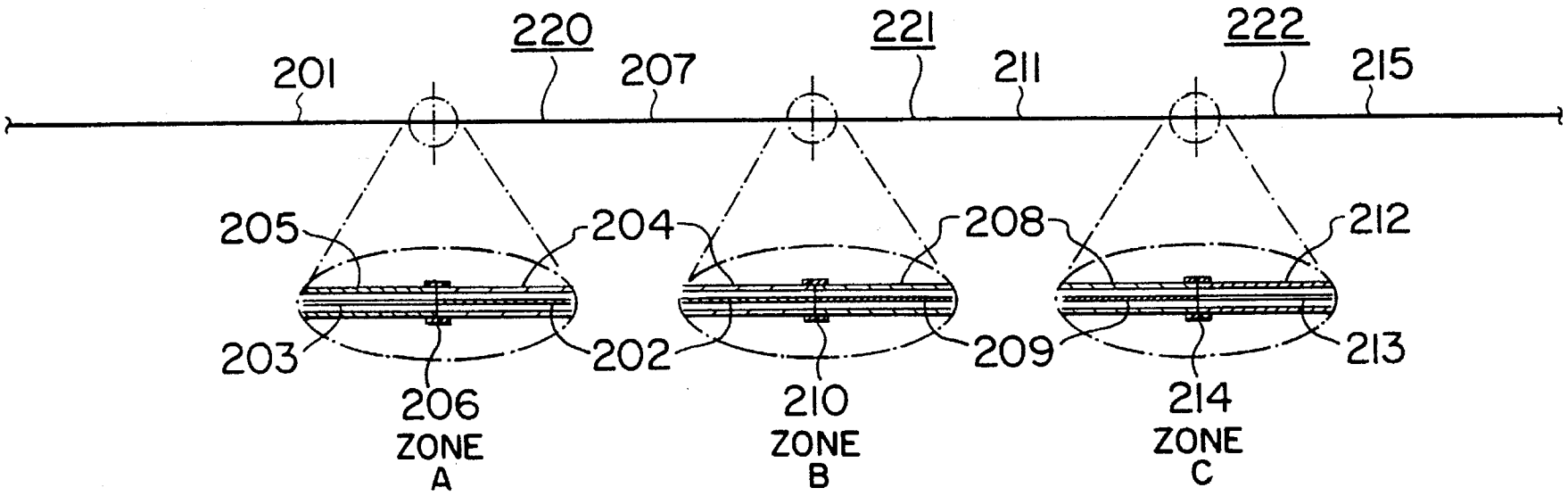
FIG. 2 is a schematic representation of a bidirectional piezoelectric sensor of an embodiment of this invention.

(ii) Description of FIG. 2

As seen in FIG. 2, the transmission cable 201, e.g., that known as RG-58 of e.g., 100 feet in length is spliced directly to a bidirectional piezoelectric cable (220) in the following manner, as shown in ZONE A.

The copper conductive core 202 of the first piezoelectric cable 220 is spliced to the copper conductive core 203 of the transmission cable 201. The braided copper sheath 204 of the piezoelectric cable 220 is spliced to the copper sheath 205 of the transmission cable 201. The splice is then encapsulated in a molded rubber jacket 206. This provides a length, e.g., eight feet of a positive piezoelectric sensor 207.

The positive piezoelectric sensor 207 is spliced to a second piezoelectric cable (221) in the following manner as shown in ZONE B.

The copper conductive core 202 of the positive piezoelectric sensor 207 is spliced to the copper sheath 208 of the second piezoelectric cable 221. The copper sheath 204 of the positive piezoelectric sensor 207 is spliced to the copper core 209 of the second piezoelectric cable 221. A polyethylene jacket 210 is applied after splicing. This provides a length, e.g., four feet of a neutral piezoelectric sensor 211.

The neutral piezoelectric sensor is spliced to a third piezoelectric cable (222) in the following manner as shown in ZONE C.

The copper sheath 208 of the neutral piezoelectric sensor 211 is spliced to the copper sheath 212 of the third piezoelectric cable 222. The copper conductive core 209 of the neutral piezoelectric sensor 211 is spliced to the copper conductive core 213 of the third piezoelectric cable 222. A polyethylene jacket 214 is applied after splicing. This provides a length, e.g., eight feet of a negative piezoelectric sensor 215.

Both eight feet sensors sections 207,215 are active piezoelectric sensors. The piezoelectric cable is an oval coaxial cable, of dimensions 6 mm ×4 mm, and will be described hereinafter.

The splices between the positive piezoelectric sensor 207 and the neutral piezoelectric sensor 207, and between the neutral piezoelectric sensor 207 and the negative piezoelectric sensor 215 are carried out by the manufacturer of the piezoelectric cable. The polyethylene jackets 210,214, are applied after the splices have been made. The splice is between the transmission cable 201 and the positive piezoelectric sensor 207 is carried out on site, and is then encased in cast rubber 206.

Figure 3:
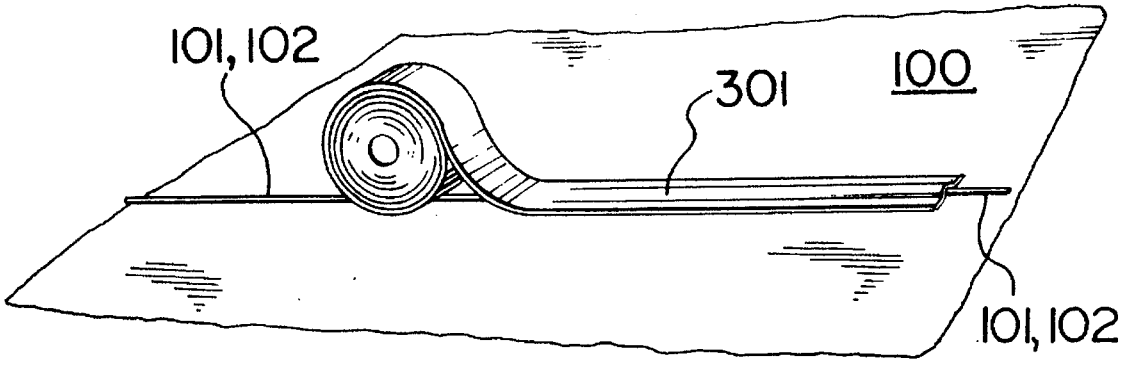
FIG. 3 is a perspective representation of a manner of installation of the bidirectional piezoelectric sensor of an embodiment of this invention.

(iii) Description of FIG. 3

As seen in FIG. 3 after the splices have been formed to provide the bidirectional piezoelectric sensor, 101,102, it is laid on the surface of the roadway 100 by means of road tape 301.

Figure 4:
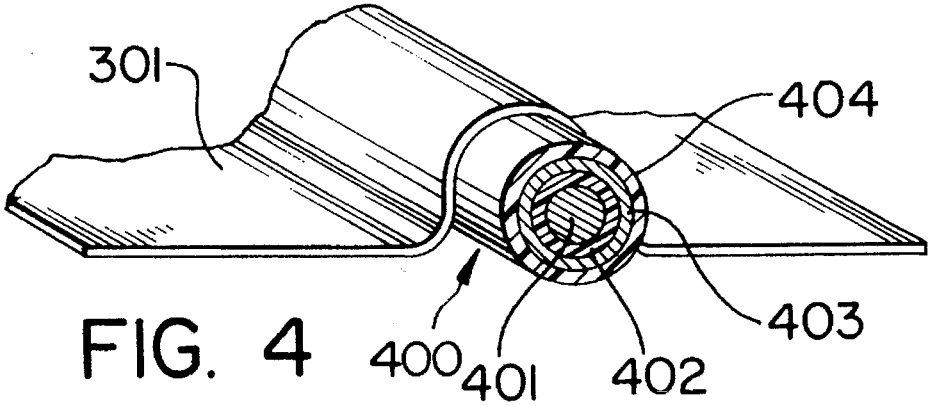
FIG. 4 is a perspective, cross-sectional view of the piezoelectric cable forming part of the present invention.

(iv) Description of FIG. 4

As has been generally described heretofore, but which will now be described specifically with respect to FIG. 4, the piezoelectric cable 400 includes a copper conductive core 401 surrounded by a polymeric piezoelectric material 402. The polymeric piezoelectric material 402 is encased in a braided copper sheath 403. The braided copper sheath 403 is encased by a polyethylene jacket 404.

Also shown in FIG. 4 is the road tape 301.

GENERALIZED DESCRIPTION OF THE INVENTION

The bidirectional sensor of the present invention is a single piezoelectric axle detector capable of simultaneously monitoring two lanes of traffic for counting or classifying.

As described above, the sensor consists of two, eight foot independent active sections of piezoelectric cable, connected by a four foot neutral zone. The overall cable is connected to the interface electronics via a shielded RG-58 coaxial lead cable, sixty-five feet to one hundred feet long. Each active zone is capable of independent axle detection.

The piezoelectric sensor is of oval coaxial design, approximately ¼"×1/8" in cross-section. The piezoelectric material is a polymer for high durability and reliability as well known in the art, to be described later.

As shown hereinabove, the sensor is capable of being taped down to the road surface, with each section of active piezoelectric material being disposed in a separate lane. The response of the sensor is such that the output of the sensor from one lane is electrically opposite to that of the sensor section in the other lane.

The bidirectional piezoelectric sensor interface board is an after market product which allows counter/classifiers known by the Trademarks, STREETERAMET TRAFCOMP III™ Model 241 and DIAMOND TRAFFIC™ to interface with the bidirectional piezoelectric sensor of the present invention.

Each interface board fits into the Model 241 and Diamond counter/classifier units. Two boards can be installed into the TRAFCOMP III™ 241, each providing two bidirectional sensor inputs (i.e., four independent channels). Diamond units will be provided in a single board allowing for four sensor inputs (i.e., eight independent channels).

The interface board decodes the output of each bidirectional sensor and determines the sensor triggered.

The present invention is also compatible with an external interface electronics which is able to accommodate any traffic counter/classifier with a piezoelectric input with either two or four bidirectional inputs. The interface electronics is of a low power consumption design for operation on a +5 V DC power supply.

The sensors used in the present invention are well known piezoelectric transducers, and may be those described in U.S. Pat. No. 4,354,134 to Micheron, U.S. Pat. No. 4,629,925 to Booth et al, U.S. Pat. No. 4,609,845 to Soni, U.S. Pat. No. 4,547,691 to Valdois and U.S. Pat. No. 4,383,239 to Robert (the entire content of each being expressly incorporated hereinto by reference), as well as those described in Canadian Patent Nos. 1,218,869 to Strachon, 972,181 to Ayers et al, and 1,267,216 to Soni et al.

As is well known, piezoelectric material include "a conductive polymer". The term "conductive polymer" is used to mean a polymeric composition which has been rendered electrically conductive by filling a polymer or polymer blend with an electrically conductive filler such as carbon black, graphite powder, metal particles such as nickel powder, and carbon, graphite or metal fibers. Carbon black is an especially preferred filler and is preferably used in amount ranging from 5 to 50 weight per cent. The conductive polymer must not degrade at the piezoelectric polymer stretching temperature, which may be as high as about 170° C., nor should it soften or melt below about 60° C. The conductive polymer must stretch along with the piezoelectric polymer, which means that it must have an elongation of at least about 200 to 400 per cent under the stretching conditions. In order to provide maximum electrical contact and minimize voiding, it must bond well to the piezoelectric polymer and the LMPM. Furthermore, low resistivity after stretching is important. For conductive polymers derived from an elastomeric material, this means a resistivity of below about 500 ohm-cm after stretching 200 to 400 per cent. Preferably, the conductive polymer should have a lower modulus and a higher elongation than the piezoelectric polymer.

Polymers suitable for making the conductive polymer include homopolymers and copolymers of ethylene, acrylic acid, acrylic acid esters (especially the ethyl and methyl esters), methacrylic acid, methacrylic acid esters (especially the ethyl and methyl esters), acrylonitrile, vinyl acetate, vinyl fluoride, vinyl chloride, vinylidene fluoride, vinylidene chloride, hexafluoropropylene, trifluoroethylene, chlorotrifluoroethylene, and tetrafluoroethylene. Particularly preferred among these are polymers compatible with $PVF_2$: $PVF_2$, poly(ethylene-coethyl acrylate), poly(ethylene-co-acrylic acid), elastomeric hexafluoropropylene copolymers, e.g., VITON™, a fluoroelastomer commercially available from Du Pont, and acrylic ester elastomers, e.g., VAMAC™, also commercially available from Du Pont. By compatible, it is meant that the polymer bonds to $PVF_2$ strongly enough so that substantial interfacial contact is maintained even after a stretching process, typically at about 100° C. and for 200 to 400 per cent. Fluorinated and acrylic elastomers require greater loadings of the conductive filler to become electrically conductive, but, in compensation, have greater elongation when loaded and retain their conductivity better upon stretching.

The piezoelectric member may be formed from any material that can be rendered piezoelectric by orientation and polarization. Such materials include poly(ethylene terphthalate), nylon 5, nylon 7, poly(hydroxybutyrate), poly-(acrylonitrile-co-vinyl acetate), and vinylidene fluoride polymers. The term "vinylidene fluoride polymer" is intended to include poly(vinylidene fluoride polymer" is intended to include poly(vinylidene fluoride), commonly abbreviated to "PVDFG" or "$PVF_2$" and those copolymers of vinylidene fluoride which can be rendered piezoelectric by orientation and polarization. Suitable copolymers include copolymers and terpolymers of vinylidene fluoride with vinyl fluoride, trifluoroethylene, tetrafluoroethylene, vinyl chloride, and chlorotrifluoroethylene. In addition, blends of vinylidene fluoride polymers with other polymers, e.g., poly(methyl methacrylate), are included provided that the piezoelectric activity itself is not destroyed. Composites made from vinylidene fluoride polymers and filled vinylidene fluoride polymers may also be used. Preferably the piezoelectric member comprises a vinylidene fluoride polymer, more preferably poly(vinylidene fluoride) and especially it consists substantially solely of poly(vinylidene fluoride).

Preferred elastomers are acrylic elastomers, such as ethylene/acrylic ester polymers. Examples of such elastomers include: an ethylene/alkyl acrylate or ethylene-alkyl methacrylate copolymer where the alkyl group has 1–4 carbon atoms; the proportion of the acrylic ester being about 2.4–8.0 moles of ester groups per kilogram of the copolymer; a terpolymer of ethylene with an alkyl acrylate of methacrylate wherein the alkyl group has 1–4 carbon atoms, and a third copolymerizable monomer, which may be, for example one of the following: a $C_1$–$C_{12}$ alkyl monoester or diester of a butenedioic acid; acrylic acid; methacrylic acid; carbon monoxide; acrylonitrile; a vinyl ester; an alkyl acrylate or alkyl methacrylate, the alkyl group having at least five carbon atoms; and maleic anhydride.

Typical acrylic elastomers of this type can be a simple copolymer of ethylene with methyl acrylate, ethyl acrylate, propyl acrylate isopropyl acrylate, a butyl acrylates, methyl methacrylate, ethyl methacrylate, propyl methacrylate, isopropyl methacrylate, a butyl methacrylate or vinyl acetate. Such copolymers if not commercially available, can be made by conventional and well known methods.

The terpolymer of ethylene with an acrylic ester and a third monomer may contain as the third monomer an ester of fumaric acid or maleic acid, wherein the alcohol moiety can be, for example, methyl, ethyl, propyl, isopropyl, various isomers of butyl, pentyl, hexyl, heptyl, octyl, nonyl, decyl, undecyl, dodecyl and the like. The third monomer may also be, among others, a vinyl ester such as for example, vinyl acetate or vinyl butyrate.

Thermoplastic elastomers include, for example, segmented copolyesters, thermoplastic polyurethanes, styrene-butadiene block copolymers, and ionomers. Illustrated thermoplastic elastomers are segmented copolymers consisting essentially of recurring intralinear long chain ester units and short chain ester units randomly joined head-to-tail through ester linkages. Such copolyesters are derived, for example, from terephthalic acid, tetramethylene ether glycol and 1,4-butadiene.

The high molecular weight polymer is rendered conductive by dispersing therein conductive particles. The conductive particles can be conductive carbon black, particulate or fibrous graphite, metal particles or metal fibers, or combinations thereof. Preferred are carbon black particles. The resistivity of the conductive polymer material should be less than about 15,000 ohm-cm, preferably less than about 3000 ohm-cm and most preferably less than about 100 ohm-cm. It has been found that during the step of stretching the conductive polymer material during manufacture of the cable, the resistivity of the composition tends to rise. This is particularly true if the polymer used is crystalline. This is particularly true if the polymer used is crystalline. Thus, it is preferred to use a non-crystalline polymeric material. Use of an elastomer, such as elastomeric ethylene-acrylate copolymer or terpolymers, provides a conductive polymer composition whose resistivity remains essentially constant through co-extrusion and stretching processes. If, however, it is desired to use a crystalline polymer for the conductive core, annealing of the structure can reduce the resistivity toward its value prior to stretching.

A piezoelectric polymer layer surrounds the conductive polymer core. The piezoelectric polymer can be, for example poly(ethylene terephthalate), nylon 5, nylon 7, poly(hydroxy-butyrate), poly(acrylonitriles-co-vinyl acetate), and vinylidene fluoride polymers. The term "vinylidene fluoride polymer" is intended to include polyvinylidene fluoride), commonly abbreviated to "PVDF" or "$PVF_2$ and those copolymers of vinylidene fluoride which can be rendered piezoelectric by orientation and polarization. Suitable copolymers include copolymers and terpolymers of vinylidene fluoride with vinyl fluoride, trifluoroethylene, tetrafluoroethylene, vinyl chloride, and chlorotrifluoroethylene. Blends of vinylidene fluoride polymers with other polymers e.g., poly(methyl methacrylate), can be used. Composites made from vinylidene fluoride polymers and filled vinylidene fluoride polymers may also be used. Preferably the piezoelectric member comprises a vinylidene fluoride polymer, more preferably poly(vinylidene fluoride) and especially it consists substantially solely of poly(vinylidene fluoride).

The piezoelectric polymer layer in the coaxial cable should be from about 0.1 to about 2 millimeters (mm) thick and preferably from about 0.5 to about 1 mm.

The piezoelectric coaxial cable has an outer conductor which surrounds the piezoelectric layer. The outer conductor can be metallic or a conductive polymer composition.

Optionally an outer insulating jacket may be applied around the outer conductor. The jacket may be made from any material which is a good electrical insulator and which provides the desired degree of mechanical protection. For example, polyethylene, vulcanized rubber, or poly(vinyl chloride) can be used. Poly(vinyl chloride) is particularly preferred. Additional layers of the piezoelectric member, separated from each other by an intervening conductive polymer layer, may be added over the outer conductor, thereby increasing the piezoelectric response. An example of such a construction is a coaxial cable comprising a conductive polymer core, a first piezoelectric polymer layer surrounding the core, a second conductive polymer layer surrounding the first piezoelectric polymer layer, and a second piezoelectric polymer, etc. and finally an outermost conductor which may be either a metal or a conductive polymer.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A bidirectional road traffic sensor comprising:

(i) a first length of a coaxial piezoelectric cable having a conductive core, a conductive polymer surrounding the core, a conductive sheath therearound and an electrically non-conductive jacket therearound;

(ii) a second length of a coaxial piezoelectric cable having a conductive core, a conductive polymer surrounding the core, a conductive sheath therearound and an electrically non-conductive jacket therearound;

(iii) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor;

(iv) a third length of a coaxial piezoelectric cable having a conductive core, a conductive polymer surrounding the core, a conductive sheath therearound, and an electrically non-conductive jacket therearound; and (v) a second splice between the second length of coaxial piezoelectric cable and the third length of piezoelectric cable in which the conductive core of the second length of piezoelectric cable is spliced to the conductive core of the third piezoelectric cable, and in which the conductive sheath is spliced to the conductive sheath of the second piezoelectric cable, the second splice being encapsulated in an electrically non-conductive material; thereby constituting the second length of piezoelectric cable as a neutral piezoelectric sensor, and further constituting the third length of piezoelectric cable as a negative piezoelectric sensor.

2. The bidirectional road traffic sensor of claim 1 wherein said conductive core is made of copper.

3. The bidirectional road traffic sensor of claim 1 wherein said conductive sheath is formed of braided copper.

4. The bidirectional road traffic sensor of claim 1 wherein said conductive polymer is polyvinylidene chloride.

5. The bidirectional road traffic sensor of claim 1 wherein said non-conductive jacket is formed of polyethylene.

6. The bidirectional road traffic sensor of claim 1 wherein said first and said second splices are encapsulated in polyethylene.

7. The bidirectional road traffic sensor comprising:

(i) a shielded coaxial cable including a conductive core, a conductive sheath and an electrically non-conductive jacket therearound;

(ii) a first length of a coaxial piezoelectric cable having a conductive core, a conductive polymer surrounding the core, a conductive sheath therearound and an electrically non-conductive jacket therearound;

(iii) a splice between the shielded coaxial cable and the first length of coaxial piezoelectric cable in which the conductive core of the coaxial lead cable is spliced to the conductive core of the first length of piezoelectric cable, and in which the conductive sheath of the coaxial lead cable is spliced to the conductive core of the first piezoelectric cable, the third splice being encapsulated in an electrically non-conductive material, thereby constitutes the shielded coaxial cable as a lead cable;

(iv) a second length of a coaxial piezoelectric cable having a conductive core, a conductive polymer surrounding the core, a conductive sheath therearound and an electrically non-conductive jacket therearound;

(v) a first splice between the first length of coaxial piezoelectric cable and the second length of piezoelectric cable in which the conductive core of the first length of piezoelectric cable is spliced to the conductive sheath of the second piezoelectric cable, and in which the conductive sheath of the first piezoelectric cable is spliced to the conductive core of the second piezoelectric cable, the first splice being encapsulated in an electrically non-conductive material, thereby constituting the first length of piezoelectric cable as a positive piezoelectric sensor;

(vi) a third length of a coaxial piezoelectric cable having a conductive core, a conductive polymer surrounding the core, a conductive sheath therearound, and an electrically non-conductive jacket therearound; and (vii) a second splice between the second length of coaxial piezoelectric cable, and the third length of piezoelectric cable, in which the conductive core of the second length of piezoelectric cable is spliced to the conductive core of the third piezoelectric cable, and in which the conductive sheath is spliced to the conductive sheath of the second piezoelectric cable the second splice being encapsulated in an electrically non-conductive material, thereby constituting the second length of piezoelectric cable as a neutral piezoelectric sensor, and also constituting the third length of piezoelectric cable as a negative piezoelectric sensor.

8. The bidirectional road traffic sensor of claim 7 wherein said conductive core is made of copper.

9. The bidirectional road traffic sensor of claim 7 wherein said conductive sheath is formed of braided copper.

10. The bidirectional road traffic sensor of claim 7 wherein said conductive polymer is polyvinylidene chloride.

11. The bidirectional road traffic sensor of claim 7 wherein said non-conductive jacket is formed of polyethylene.

12. The bidirectional road traffic sensor of claim 7 wherein said first and said second splices are encapsulated in polyethylene.

13. The bidirectional road traffic sensor of claim 7 wherein said third splice is encapsulated in natural or synthetic rubber.

14. A system for selective detection of vehicles passing over at least one lane of a multiple number of lanes said system comprising at least two vehicle detector zones, each zone including a single bidirectional road traffic sensor comprising:

(i) a shielded coaxial cable including a conductive core, a conductive sheath and an electrically non-conductive jacket therearound;

(ii) a first length of a coaxial piezoelectric cable having a conductive core, a conductive polymer surrounding said core, a conductive sheath therearound and an electrically non-conductive jacket therearound;

(iii) a splice between said shielded coaxial cable and said first length of coaxial piezoelectric cable in which said conductive core of said coaxial lead cable is spliced to said conductive core of said first length of said piezoelectric cable, and in which said conductive sheath of the coaxial lead cable is spliced to said conductive core of said first piezoelectric cable, said third splice being encapsulated in an electrically non-conductive material, which thereby constitutes said shielded coaxial cable as a lead cable;

(iv) a second length of a coaxial piezoelectric cable having a conductive core, a conductive polymer surrounding said core, a conductive sheath therearound and an electrically non-conductive jacket therearound;

(v) a first splice between said first length of coaxial piezoelectric cable and said second length of piezoelectric cable in which said conductive core of said first length of piezoelectric cable is spliced to said conductive sheath of said second piezoelectric cable, and in which said conductive sheath of said first piezoelectric cable is spliced to said conductive core of said second piezoelectric cable, said first splice being encapsulated in an electrically non-conductive material, which thereby constitutes said first length of piezoelectric cable as a positive piezoelectric sensor;

(vi) a third length of a coaxial piezoelectric cable having a conductive core, a conductive polymer surrounding said core, a conductive sheath therearound, and an electrically non-conductive jacket therearound; and (vii) a second splice between said second length of coaxial piezoelectric cable, and said third length of piezoelectric cable, in which said conductive core of said second length of piezoelectric cable is spliced to said conductive core of said third piezoelectric cable, and in which said conductive sheath is spliced to said conductive sheath of said second piezoelectric cable, said second splice being encapsulated in an electrically non-conductive material; wherein pressure changes in said piezoelectric sensor caused by vehicle passage thereover responsively produce electrical pulses for registering the passage of vehicles moving in respective particular directions and which respectively traverse one and another of said vehicle detection zones.

15. The system of claim 14 includes two spaced-apart bidirectional piezoelectric road traffic sensors for classifying moving traffic.

16. A traffic counter including:

(a) at least two bi-directional road traffic sensors comprising:

(i) a shielded coaxial cable including a conductive core, a conductive sheath and an electrically non-conductive jacket therearound;

(ii) a first length of a coaxial piezoelectric cable having a conductive core, a conductive polymer surrounding the core, a conductive sheath therearound and an electrically non-conductive jacket therearound;

(iii) a splice between said shielded coaxial cable and said first length of coaxial piezoelectric cable in which said conductive core of said coaxial lead cable is spliced to said conductive core of said first length of piezoelectric cable, and in which said conductive sheath of said coaxial lead cable is spliced to said conductive core of said first piezoelectric cable, said third splice being encapsulated in an electrically non-conductive material, which thereby constitutes said shielded coaxial cable as a lead cable;

(iv) a second length of a coaxial piezoelectric cable having a conductive core, a conductive polymer surrounding said core, a conductive sheath therearound and an electrically non-conductive jacket therearound;

(v) a first splice between said first length of coaxial piezoelectric cable and said second length of piezoelectric cable in which said conductive core of said first length of piezoelectric cable is spliced to said conductive sheath of said second piezoelectric cable, and in which said conductive sheath of said first piezoelectric cable is spliced to said conductive core of said second piezoelectric cable, said first splice being encapsulated in an electrically non-conductive material, which thereby constitute said first length of piezoelectric cable as a positive piezoelectric sensor;

(vi) a third length of a coaxial piezoelectric cable having a conductive core, a conductive polymer surrounding said core, a conductive sheath therearound, and an electrically non-conductive jacket therearound; and (vii) a second splice between said second length of coaxial piezoelectric cable, and said third length of piezoelectric cable, in which said conductive core of said second length of piezoelectric cable is spliced to said conductive core of said third piezoelectric cable, and in which said conductive sheath is spliced to said conductive sheath of said second piezoelectric cable, said second splice being encapsulated in an electrically non-conductive material; wherein pressure changes in said bi-directional road traffic sensors caused by vehicle passage thereover responsively produce electrical pulses;

(b) means for removably mounting said bi-directional road traffic sensor to a roadway;

(c) signal transmitting means connected to, and actuated by, said bi-directional road traffic sensor for transmitting said electrical pulses; and (d) tally means triggered by said pulses from said signal transmitting means for tallying said pulses.

17. The traffic counter of claim 16 including two spaced-apart bidirectional piezoelectric road traffic sensors for classifying moving traffic.

* * * * *